US005867880A

United States Patent [19]

Bathelier et al.

[11] Patent Number: 5,867,880

[45] Date of Patent: Feb. 9, 1999

[54] METHOD AND DEVICE FOR PRODUCING TEXTILE PRODUCTS FROM FIBERS AND/OR FILAMENTS AND PRODUCTS OBTAINED

[75] Inventors: Xavier Bathelier, Saint-Pierremont; Francois Naudin, Floing, both of France

[73] Assignee: Sommer S.A., Nanterre, France

[21] Appl. No.: 809,626

[22] PCT Filed: Sep. 29, 1995

[86] PCT No.: PCT/EP95/03871

§ 371 Date: Jun. 18, 1997

§ 102(e) Date: Jun. 18, 1997

[87] PCT Pub. No.: WO96/10667

PCT Pub. Date: Apr. 11, 1996

[30] Foreign Application Priority Data

Sep. 30, 1994 [EP] European Pat. Off. ..... 94202840

[51] Int. Cl.[6] ..... D04H 1/74

[52] U.S. Cl. ..... 28/107; 112/80.73

[58] Field of Search ..... 28/107, 108, 109, 28/110, 113, 114; 112/80.01, 80.73; 66/9 R, 61, 83, 80, 85 R

[56] References Cited

U.S. PATENT DOCUMENTS

| | | | |
|---|---|---|---|
| 4,622,253 | 11/1986 | Levy | 28/107 |
| 4,818,586 | 4/1989 | Smith et al. | 28/107 |
| 5,239,734 | 8/1993 | Bathelier et al. | 28/107 |

FOREIGN PATENT DOCUMENTS

| | | |
|---|---|---|
| 1 660 779 | 2/1971 | Germany . |
| 42 35 858 A1 | 3/1994 | Germany . |
| 42 39 469 A1 | 5/1994 | Germany . |
| 1060905 | 3/1967 | United Kingdom . |
| 2 166 460 | 5/1986 | United Kingdom . |
| 2 268 137 | 1/1994 | United Kingdom . |
| WO 91/00382 | 1/1991 | WIPO . |
| WO 97/05315 | 2/1997 | WIPO . |

*Primary Examiner*—Michael A. Neas
*Assistant Examiner*—Larry D. Worrell, Jr.
*Attorney, Agent, or Firm*—Alix, Yale & Ristas, LLP

[57] ABSTRACT

A method for producing textiles from fibers and/or filaments circulating in the form of a web by performing transverse texturing of the fibers and/or filaments as well as stretching thereof, and collecting the fibers and/or filaments in the form of at least one crinkled pseudo-yarn (100) of a given length in which the fibers and/or filaments are properly parallelized. The method is characterized in that said fibers and/or filaments are collected in or against transfer members (9) separate from the needles and the full length of said pseudo-yarn (100) is transferred to needles (11 or 21) for receiving the pseudo-yarn (100).

22 Claims, 13 Drawing Sheets

METHOD AND DEVICE FOR PRODUCING TEXTILE PRODUCTS FROM FIBERS AND/OR FILAMENTS AND PRODUCTS OBTAINED

CROSS-REFERENCE TO RELATED APPLICATION

This is the national stage of International Application No. PCT/EP95/03871 filed on Sep. 29, 1995.

SUBJECT OF THE INVENTION

The present invention relates to an improved method for producing textile products directly from fibres and/or filaments.

The invention also relates to a device making it possible to implement the method and extends to products resulting from the method and/or obtained by means of the said device.

SUMMARY OF THE PRIOR ART

European Patent EP-A-0,479,880 granted in the Applicant's name proposed a new technique, called "verticalization" technique, for producing textile products and, more particularly, floor and wall coverings of the moquette type directly from fibres and/or filaments travelling in the form of a web. The technique involves subjecting the fibres and/or filaments to transverse looping accompanied by drawing and accumulating these fibres and/or filaments in the form of a pseudo-yarn in which the fibres and/or filaments are parallelized. The pseudo-yarn is a non-twisted wavy yarn.

This document describes that transverse looping accompanied by drawing is carried out for each individual fibre or filament by means of rotary looping elements or discs which are spaced from one another and arranged on a shaft transverse relative to the advance of the web and between which looping fingers are arranged. In principle, each fibre and/or filament is involved in at least one looping, so as to form the pseudo-yarn obtained by the accumulation of exactly parallelized elementary fibres and/or filaments. This accumulation in the form of a pseudo-yarn takes place directly in the eye of the needles according to the various embodiments illustrated in the patent.

The main disadvantage of such an arrangement is that the needles then have to be arranged exactly in the extension of the looping fingers, that is to say between the looping discs. Since the needles are so-called expendable elements, that is to say they have to be replaced regularly on account of their wear, their particular arrangement between the discs makes replacement procedures difficult.

Moreover, this configuration makes the design of the needles somewhat unconventional. In fact, the tolerances and lengths which they must have are unusual and therefore make the production of such needles particularly complicated.

This document also describes additionally that the loops taking the form of a pseudo-yarn can be fixed to one another in various ways and, inter alia, to a support.

A finished product is also described, in which the loops can be organized in the form of rows of stitches, but it does not describe the means for arriving at such a product.

At the present time, the various conventional stitching techniques can be divided essentially into two large groups: on the one hand, techniques known as "tuck stitch" and, on the other hand, techniques known as "sewing/knitting".

In the first large group, mention may be made of knitting machines of the flat type, in which a yarn is dispensed progressively and therefore successively to each of the needles by a device called a "yarn guide".

The needles then slide successively in a fixed section due to the action of a cam which is itself driven together with the thread guide by a carriage impelled in a reciprocating movement over the entire width of the machine.

The same principle of forming a stitched product can be applied to a circular knitting machine, in which the needles are mounted along the generatrices of a cylinder and moved successively in uniform rotation in one direction. This makes it possible, where appropriate, to put in place a plurality of fixed cams and thereby multiply the productivity of the machine. These machines are particularly suitable for the production of "knitted fabric" by the meter, but do not make it possible to produce fully fashioned articles.

Cotton's knitting machines are a final type of machine in the first group. In this type of machine, the yarn is not dispensed directly to the needles, but is progressively dispensed towards auxiliary members which make it possible to produce waviness in the yarn. The waves which will subsequently form the stitches are then tucked simultaneously by the needles which are fastened to a movable flat section. These knitting machines are essentially intended for the production of fully fashioned panels for clothing. However, the productivity of such machines is not very high.

It can be stressed that all the techniques forming part of the large "tuck-stitch" knitting group use a yarn which must have well-defined strength. On the other hand, in all cases, this yarn has to be dispensed progressively either directly to the needles or to intermediate members, which greatly reduces productivity. Finally, this productivity is even lower where the production of fully fashioned articles is concerned.

The second largest group consists of the techniques called "sewing/knitting" and makes use, as a starting product, of fibre laps or webs which are processed directly in order to obtain a knitted product.

To employ these methods, it is necessary that the starting product serving for feeding the knitting machines should consist of a fibrous assembly which is either in the form of a fibre lap obtained by the lapping or upholstering of an elementary web or in the form of a web folded in the direction of advance.

In the first case, stitch-forming needles, which act a little like needles of a needling machine, pick up fibres from the lap so as to organize them in the form of chains. The devices which employ this method are known by the name of "Malivlies" or "Arachne".

In the second case, to produce knitted products from a folded web, it is expedient to refer more particularly to the patents DE-A-4,235,858 or GB-A-2,268,137.

In general terms, it is appropriate to note that the products obtained by means of the techniques belonging to the large "sewing/knitting" group, although they have an appearance relatively close to that of conventional jerseys obtained from yarns, cannot in any way be compared with these as regards characteristics, such as elasticity, drape, feel or washability, and, more particularly, as regards whatever relates to the characteristics necessary for use as clothing. In fact, in the case of products produced by means of the abovementioned methods, it can be seen that the poor behaviour characteristics are attributable mainly to the fact that the same fibre participates in only a small number of stitches (method of the "Malivlies" type) or that it is trapped in a concertina-like manner within the same stitch (according to the method employing the folding of a web), thereby generally allowing elongation, but not giving the product any elasticity.

On the other hand, it can be seen that the various methods employing a fibrous mass at the outset do not allow sophisticated features which are permitted by conventional methods employing a yarn, such as the production of ribs, complex bindings (twists, etc.) or the creation of patterns generated by the positioning of needles.

On the other hand, it can be seen that these various methods make it possible to use only specific needles equipped with a point, which make it possible to pass through the fibrous lap, this being a major disadvantage in the case of fine gauge and causing the needles to be fragile.

It is found that the products obtained by the so-called sewing/knitting techniques are intended, above all, to be employed for "non-woven" uses after chemical consolidation, for example in the field of coverings or in the field of industrial panels.

OBJECTS OF THE INVENTION

The main object of the present invention is to propose a method and a device for producing textile products directly from fibres and/or filaments, as described in the patent EP-A-0,479,880, which make it possible to separate the steps of forming a pseudo-yarn and the steps of producing the product itself, either in the form of a floor covering or in the form of a knitted product.

The present invention aims, in particular, to solve the problem of producing non-standard needles.

Another aspect of the present invention is aimed at proposing a method and a device which make it possible to propose producing textile products in knitted form by eliminating the spinning step, that is to say by allowing the direct production of a "spun" (twisted, covered or bonded) yarn which is necessary for conventional stitch-forming techniques (tuck-stitch techniques), whilst preserving the particular characteristics of knitted products, which are elasticity, drape, washability, etc.

An additional object of the present invention is to propose to make it possible to use fibres and/or filaments, including fibres and/or filaments which are especially difficult to spin, directly for producing knitted products.

The object of the present invention is also to achieve the production of knitted products, in which the stitches are obtained by means of a "yarn" having even finer linear densities than those obtained by means of conventional spinning techniques.

The object of the present invention is also to achieve a better management of colour and, more particularly, to carry out dyeing directly on the fibres, without going through the step of dyeing the yarn just after the spinning step.

Other advantages and features of the present invention will be described below.

Main characteristic elements of the present invention The present invention relates to a method for producing textile products from fibres and/or filaments travelling in the form of a web, in which the individual fibres and/or filaments are subjected to transverse looping accompanied by drawing, and these fibres and/or filaments are accumulated in the form of at least one wavy pseudo-yarn of particular length, in which the fibres and/or filaments are exactly parallelized. According to the present invention, these fibres and/or filaments are accumulated against or in picking and transfer elements, and these picking and transfer elements will subsequently transfer the pseudo-yarn towards needles over its entire length, preferably simultaneously.

According to a first embodiment, these needles can be tufting needles, for the purpose of producing a product, such as a floor and/or wall covering.

According to another embodiment, the needles can be stitch-forming needles which make it possible to produce an additional row of stitches of a knitted product.

The present invention makes it possible for the needles to execute movements of low amplitude, whilst the transfer is carried out by independent picking and transfer elements which, if necessary, execute a movement of higher amplitude.

It is appropriate to note that these picking and transfer elements can be given minimum dimensions, since they no longer have to perform any function other than the transfer of the pseudo-yarn.

The present invention also relates to the device for implementing the method according to the invention, the said device comprising rotary looping elements which are spaced from one another and are arranged on a shaft transverse relative to the advance of the web and between which looping fingers are arranged. Provided in the extension of each looping finger is a picking and transfer sinker, on which the fibres and/or filaments intended for forming the pseudo-yarn come into abutment. When this pseudo-yarn is produced, the said picking and transfer sinkers subsequently execute the transfer of the said pseudo-yarn as far as needles.

According to a first embodiment, the needles can be tufting needles intended for fixing the pseudo-yarn to a support, for example for the purpose of producing a floor and/or wall covering.

According to another embodiment, the needles are stitch-forming needles which are intended to use the pseudo-yarn for the purpose of producing an additional row of stitches.

According to another embodiment of the present invention, the stitch-forming needles are in the form of two series. In this case, a first series of stitch-forming needles receives the yarn produced and carries out the production of an additional row of stitches; subsequently, this first series of stitch-forming needles transfers the same yarn towards a second series of stitch-forming needles which, in turn, carry out the production of a row of stitches. This makes it possible to obtain the production of a knitted product which takes the form of ribs.

According to another embodiment, if the intention is to produce looped or plaited knitted products, it is conceivable to produce a plurality of pseudo-yarns simultaneously by accumulation against independent picking and transfer elements. Each of the pseudo-yarns produced is subsequently transferred, in turn, towards stitch-forming needles which receive them successively and which successively carry out the production of an additional row of stitches.

The present invention also relates to textile products in knitted form which are obtained by means of the method and device described above. These textile products are essentially characterized in that they have a network of interfering fibres and/or filaments which extends in both directions and which makes it difficult for the product to unravel. The ratio of fibres and/or filaments is preferably between 2 and 25%.

On the other hand, it can be seen that the knitted product is perfectly balanced, so that it has no tendency to curl.

The present invention also relates to the use of the method or device according to the present invention for producing knitted products of the jersey, rib, structured, raised-nap, plaited or jacquard type.

Another use would be to produce fully-fashioned, that is to say directly shaped knitted products.

DETAILED DESCRIPTION OF SEVERAL EMBODIMENTS OF THE PRESENT INVENTION

The devices, as described in FIGS. 1 to 4, are devices which would be "grafted" onto a pseudo-yarn preparation line by means of the verticalization technique described in European Patent EP-A-0,479,880. This means that the entire preparation of the web for the purpose of obtaining a pseudo-yarn, that is to say the opening, carding, napping and prior orientation of the fibres, would essentially be carried out according to the procedures described in this european patent.

If appropriate, the improvements provided could also be adapted to this verticalization device, as described in the patent application EP-95870093.2.

In practice, to obtain the said pseudo-yarn, transverse looping, accompanied by drawing, is carried out for each individual fibre and/or filament by the interpenetration of metal parts, so as to give each fibre and/or filament a wavy shape.

The looped elementary fibres are subsequently accumulated by compression in the direction of advance, in order to form a transverse row of loops. This accumulation makes it possible to achieve very good parallelization of the fibres. At this stage, therefore, with the exception of the twisting, a yarn in wavy form, having a desired gauge or linear density, has been formed.

It is preferable that the density or, more specifically, the weight per unit area of the web of fibres and/or filaments be low, preferably between 15 and 50 g/m$^2$, in order to optimize this step of producing a wavy yarn.

It is appropriate that most of the component elements of the web, that is to say the fibres and/or filaments, should have an angle of orientation relative to the direction of advance of the web of between 15 and 45 degrees, preferably between 20 and 35 degrees.

Figure 1:
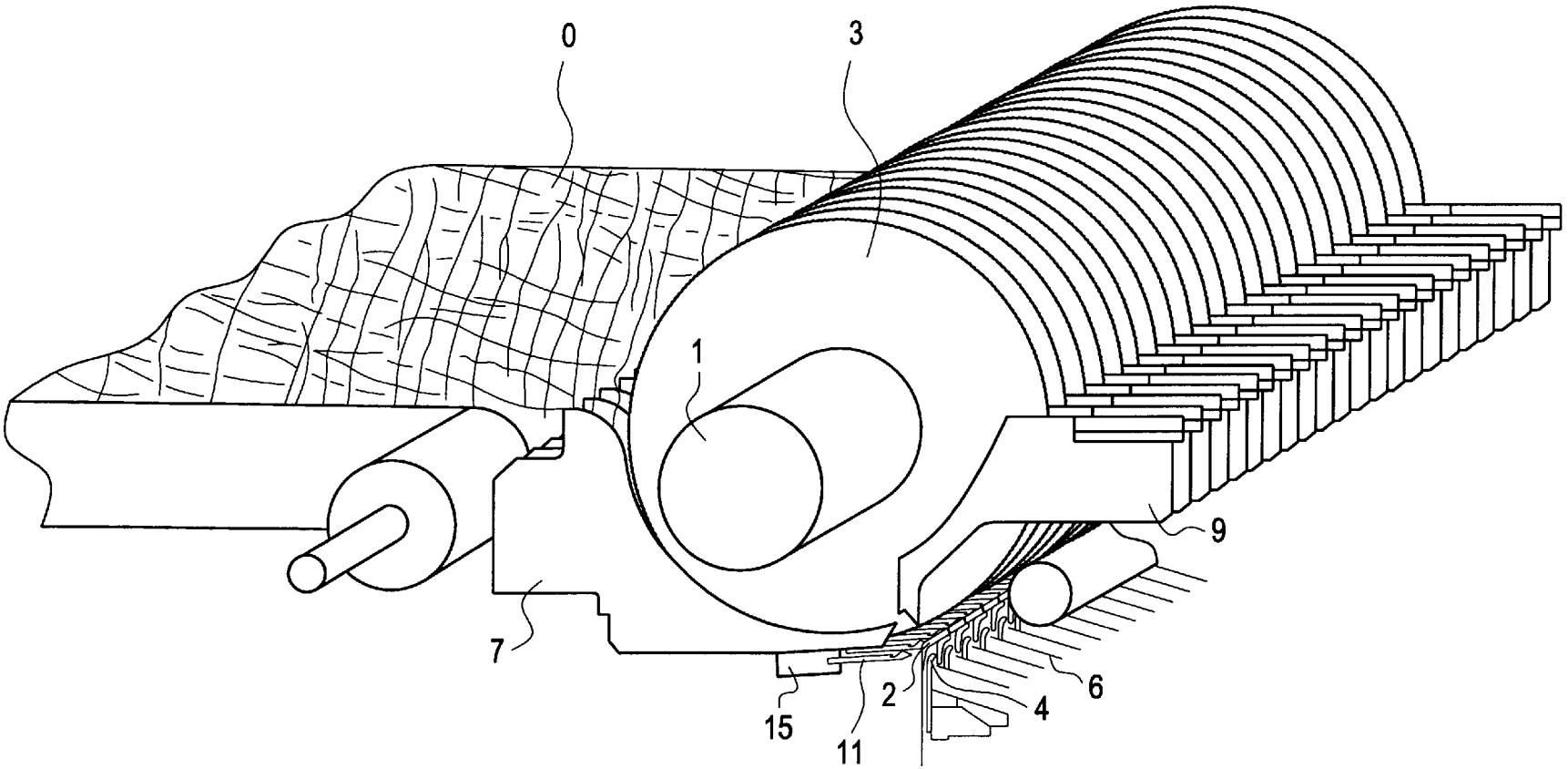
FIG. 1 shows a diagrammatic perspective view of a device according to the present invention, intended for producing a tufted product.
Figure 2:
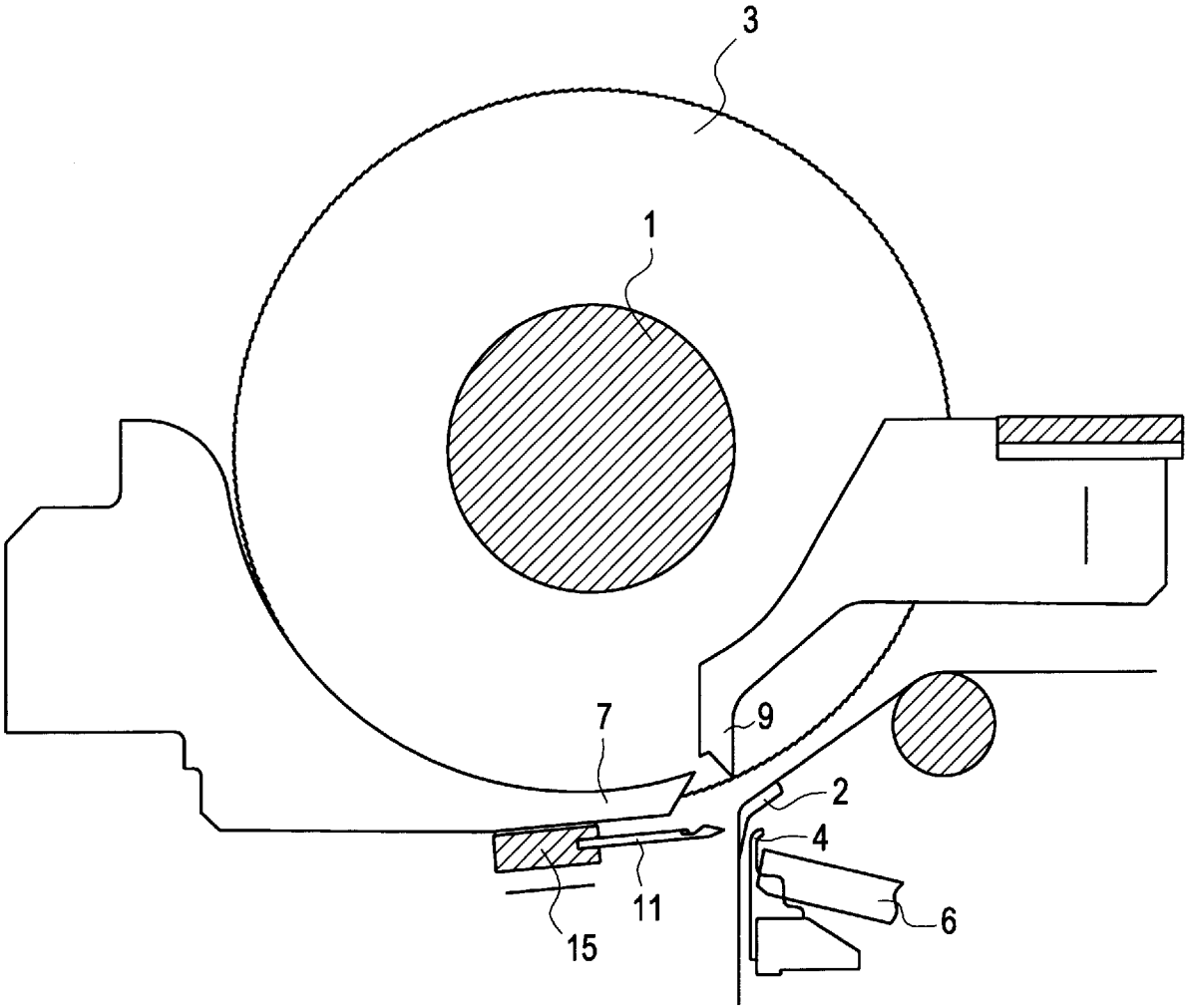
FIG. 2 shows a cross-sectional view of the device illustrated in FIG. 1.
Figure 3:
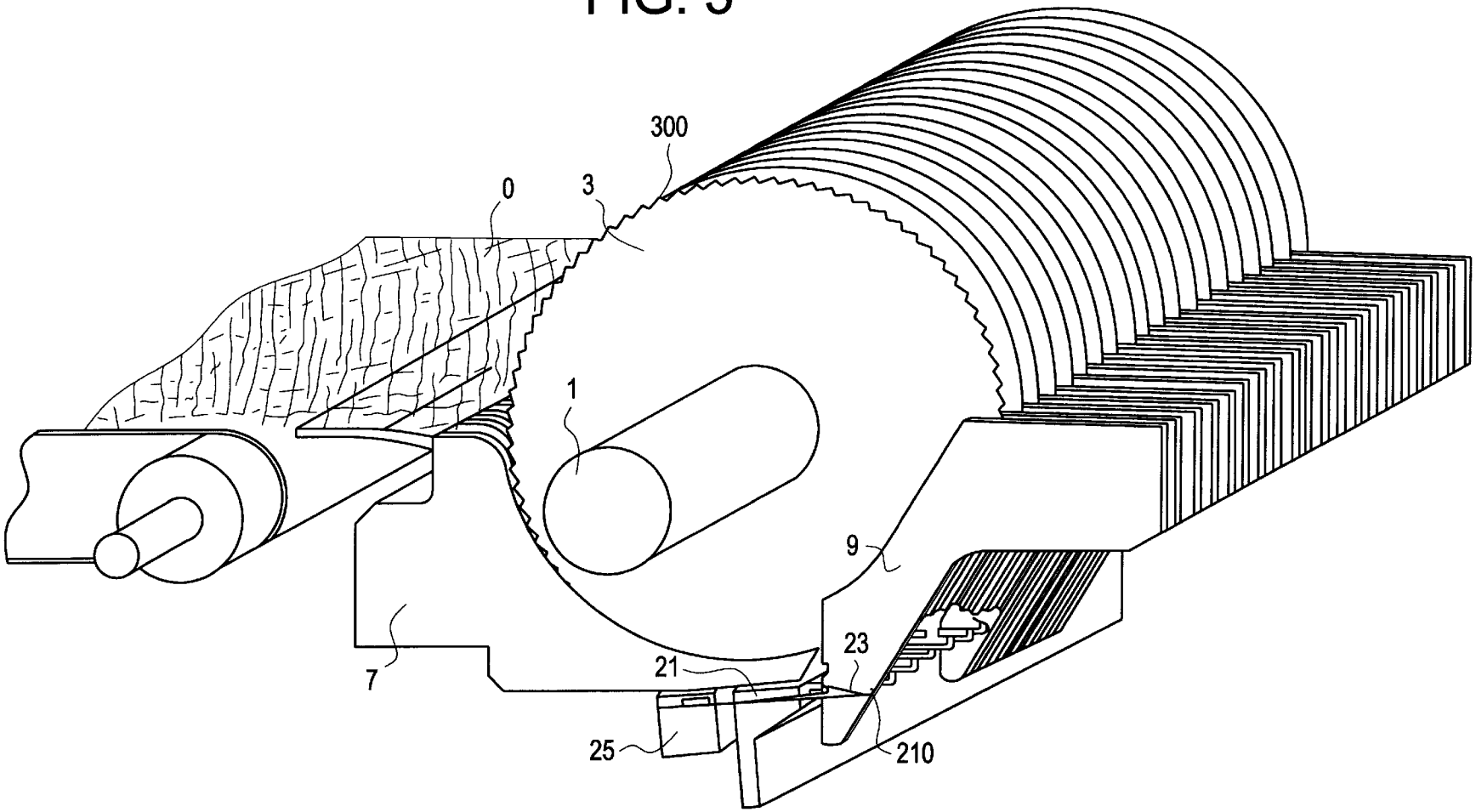
FIG. 3 shows a diagrammatic perspective view of a device according to the present invention, intended for producing a knitted product which is in jersey form.
Figure 4:
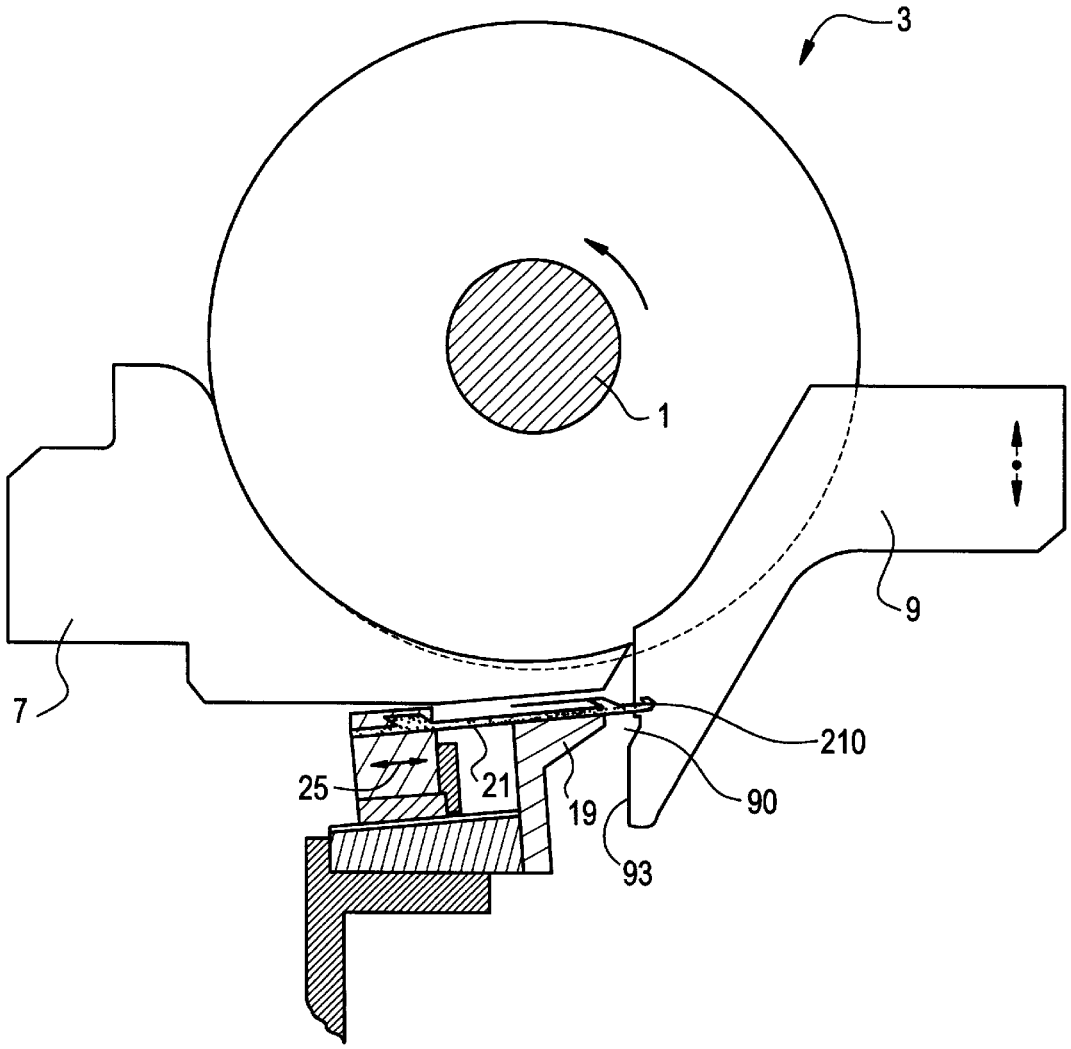
FIG. 4 shows a cross-sectional view of the device illustrated in FIG. 3.

FIGS. 1 and 3 each show a diagrammatic perspective view of two embodiments of a device according to the present invention, these figures each showing a series of sets of elements which are multiplied over the entire width of the corresponding devices (also called the working width), whilst FIGS. 2 and 4 each show a cross-sectional view in which a single set of elements appears.

In fact, if J is defined as the gauge of the machine (that is to say, the number of needles per inch), each of the elements shown in FIGS. 3 and 4 is found J times per inch.

These figures show in a conventional way a web 0 which consists of fibres and/or filaments and which advances towards the device, in order to be subjected there, transversely to the direction of advance, to looping accompanied by drawing.

For this purpose, the devices each comprise a common transverse shaft 1 driving a series of looping elements 3, preferably at a continuous rotational speed, in such a way that the peripheral speed of the looping elements 3 is equal to the entry speed of the web 0 consisting of fibres and/or filaments.

These looping elements 3 are generally looping discs provided with a toothing 300 over their entire periphery. This toothing 300 forms an angle relative to the tangent, thus making it possible to drive the fibres and/or filaments.

A looping finger 7 is arranged between each looping element 3. The interpenetration of the various looping elements 3 with the looping fingers 7 causes a looping, accompanied by transverse drawing, of the fibre or filament in an individual manner (this looping operation will be described in more detail below by means of FIGS. 5*a* to 5*c*).

Provided in the extension of each looping finger 7 is a picking and transfer sinker 9, on which the fibres come into abutment and where they accumulate to form the above-mentioned non-twisted wavy pseudo-yarn. This pseudo-yarn is not shown in the various FIGS. 1 to 4.

FIGS. 1 and 2 illustrate more particularly a first embodiment which is intended for producing a tufted product and which shows picking and transfer sinkers 9 which transfer the wavy yarn, obtained by the accumulation of the exactly parallelized fibres and/or filaments, as far as tufting needles 11.

It is appropriate to note that, according to the embodiment described in FIGS. 1 and 2, the arrangement of the tufting needles is a little special, more specifically these needles being arranged horizontally, whilst the support, in which the needles will arrange the pseudo-yarn in the form of loops, advances vertically upwards towards these tufting needles. FIGS. 1 and 2 show, in addition to the various elements mentioned above, a series of anvils 2, on which the support intended for producing the floor covering is displaced. These anvils serve as reaction elements for the penetration of the needles 11 into the support. Moreover, there are provided, in a conventional way, hooks 4, which retain their various loops produced by means of the pseudo-yarn, and knives 6 which are used when it is intended to produce a covering in the form of cut tufting.

According to another embodiment illustrated in FIGS. 3 and 4, which show more particularly a device intended for producing a knitted product, the picking and transfer sinkers 9 make it possible to transfer the pseudo-yarn, likewise obtained by the accumulation of the exactly parallelized fibres and/or filaments, as far as stitch-forming needles 21 which themselves ensure the formation of an additional row of stitches.

It is appropriate to note that, in the various embodiments illustrated in FIGS. 1 to 4, the transfer of the pseudo-yarn takes place simultaneously over its entire length, which generally corresponds to the working width, by means of picking and transfer sinkers which execute exactly the same movement, preferably simultaneously. Likewise, the tufting 11 or stitch-forming 21 needles are all mounted on a single movable section 15 or 25 which likewise simultaneously executes the same movement for receiving the pseudo-yarn and for producing either an additional row of loops in a floor covering support (see FIGS. 1 and 2) or an additional row of stitches (see FIGS. 3 and 4).

Figure 5A:
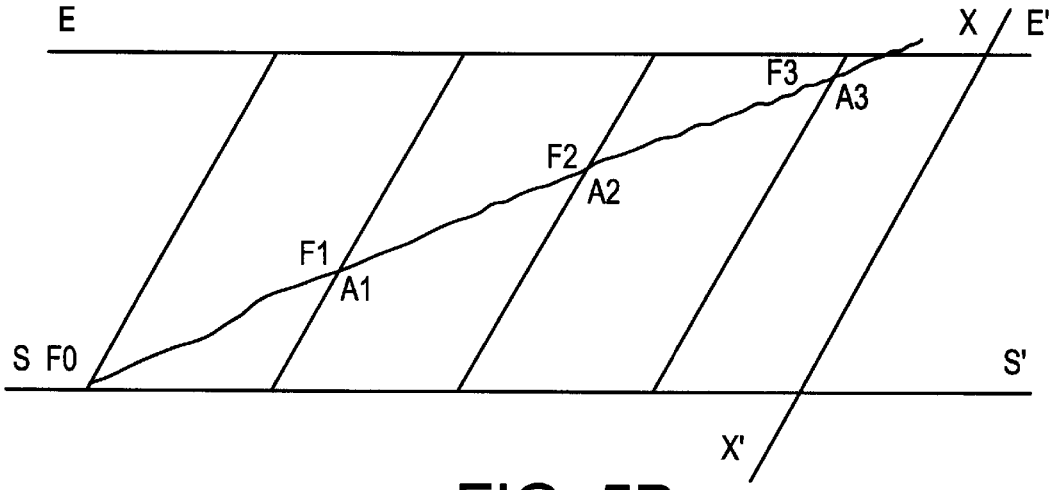
FIGS. 5*a* to 5*c* show the theoretical behaviour of a fibre during the particular looping step for a device according to the present invention.
Figure 5B:
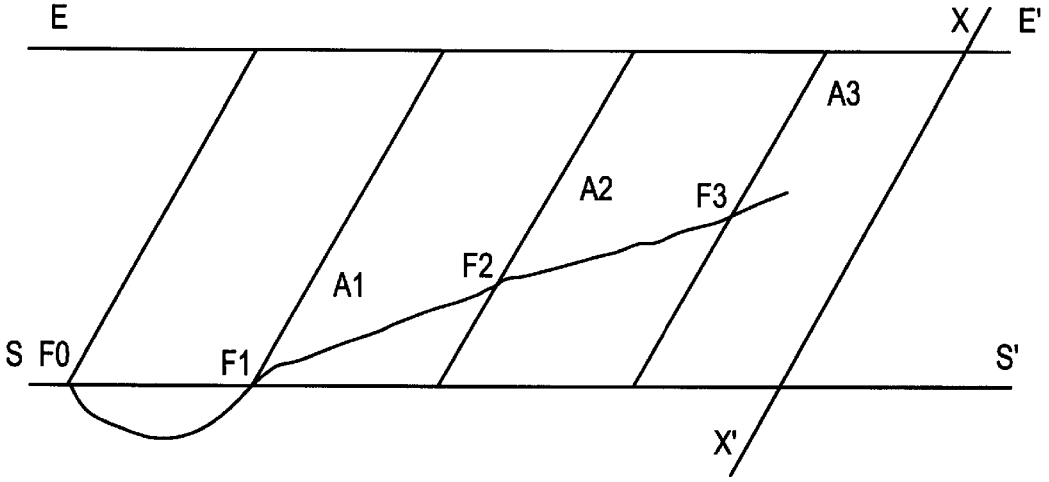
Figure 5C:
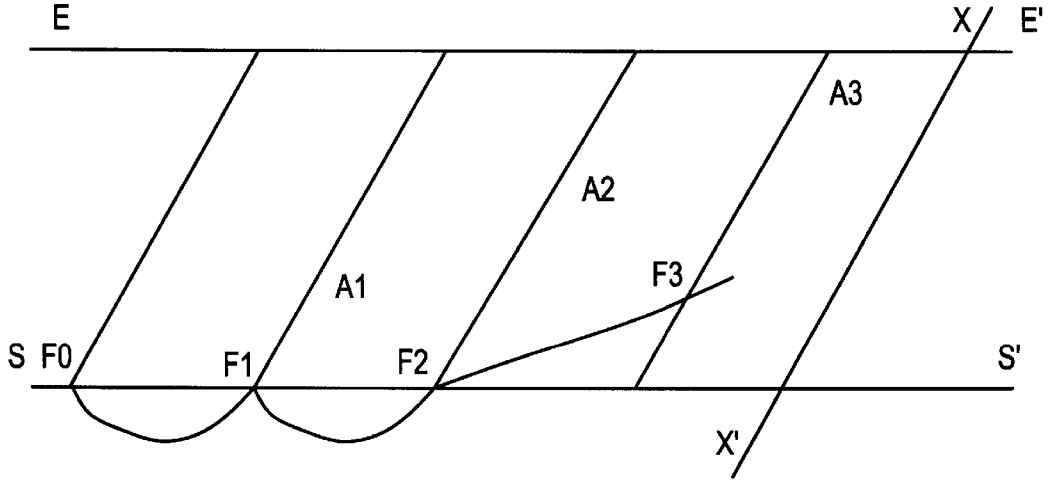

Referring to FIGS. 5*a* to 5*c,* these reveal the relation which exists between the prior orientation of the fibres in the web and the quality of the pseudo-yarn obtained.

More specifically, FIGS. 5*a* to 5*c* illustrate diagrammatically the theoretical behaviour of a fibre through the device for the looping and formation of the pseudo-yarn, these figures showing:

- the axis EE' which represents the transverse axis of entry into the device (penetration of the discs into the fingers)
- the axis SS' which represents the transverse axis of exit or of introduction of the sinkers
- the segments, such as BB', represent the looping fingers spaced from one another at the distance corresponding to the gauge J, namely L=25.4 mm/J. The discs making it possible for the fibres to advance are not shown.

In FIG. 5*a,* it can be seen that the fibre F0 F3 is already engaged in the device. Its head F0 has just encountered a sinker on the axis SS' and is therefore blocked. The points F1, F2 and F3 of the fibre coincide respectively with the points A1, A2 and A3 of the looping fingers.

In FIG. 5*b,* it can be seen that the discs have caused the advance of the fibre (that is to say, its displacement along XX'). During this operation, F1 has slid along the looping finger B1 B'1, has encountered the axis SS' and has been blocked in turn. A wave of the fibre has thus been obtained between F0 and F1.

In FIG. 5*c,* it can be seen that F2 has, in turn, reached the axis SS' and stopped. The looping of the fibre between B0, B1 and B1, B2 is terminated. The continuing rotation of the disc will bring about the formation of loops over the entire length of the fibre according to the same logic. This accumulation of such individually waved fibres will reconstitute a yarn of the desired linear density. It will be appreciated that all the fibres waving in the same way are perfectly parallelized in the yarn thus formed.

If LFA is defined as the fibre length necessary for producing a loop or a stitch, it can therefore be seen that it is necessary that:

$$LFA = AA1 = A1A2 = \ldots,$$

that is to say that the length of the wave is equal to LFA.

Let the angle of orientation of the fibres in the web be such that:

$$\sin\alpha = \frac{L}{LFA} = \frac{25.4}{J \times LFA}$$

It can also be seen that, if this condition is satisfied, the tension in the fibre during its looping will be very low, and that its intactness will be preserved, since the looping or waving of the fibre is induced by its advance and is not "forced" by the penetration of the discs into the looping fingers.

FIGS. 6*a* to 6*f* illustrate in general terms the various steps of the method according to the present invention in the particular case of the production of a knitted product in jersey form.

Figure 6A:
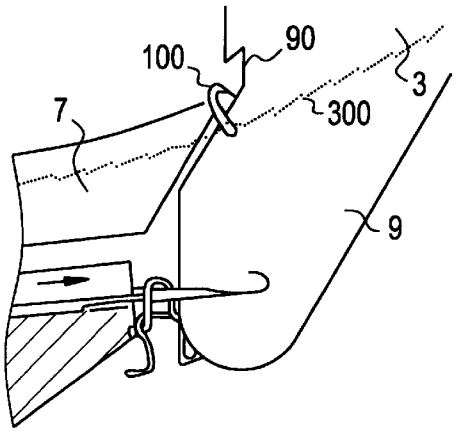
FIGS. 6*a* to 6*f* show a general view of the various steps of the method according to the invention which makes it possible to form a jersey knitted product.
Figure 6B:
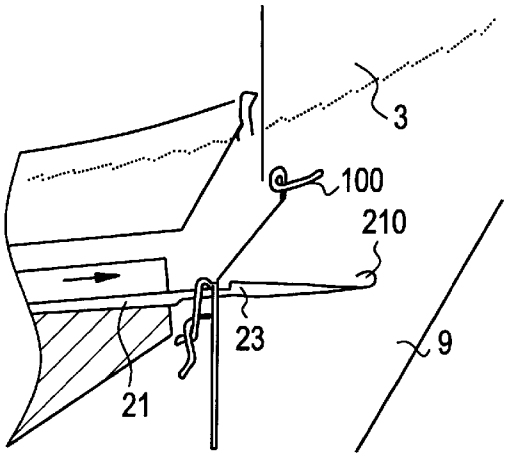
Figure 6C:
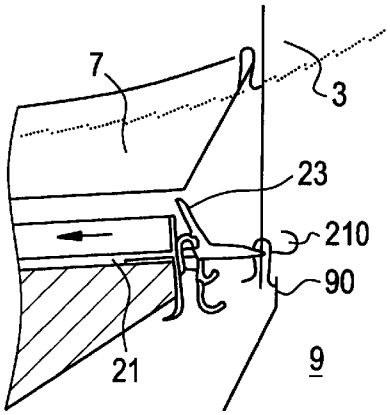
Figure 6D:
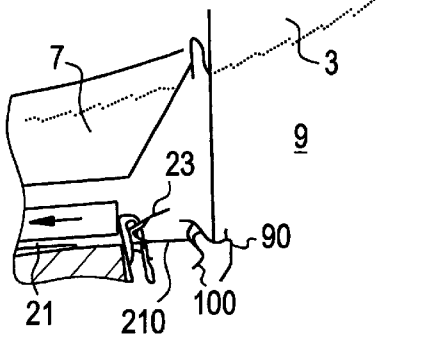
Figure 6E:
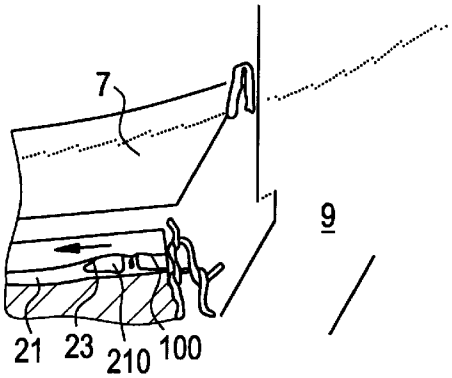

It is appropriate to note that the production of a tufted product repeats essentially the same steps as those described in FIGS. 6*a* to 6*c*. The subsequent steps involve the penetration of the needle into the substrate and the hooking-up of the pseudo-yarn which are conventional tufting operations (not shown). The cycle of the formation and accumulation of the pseudo-yarn in the transfer sinker, where tufting is concerned, is strictly the same as that illustrated in FIGS. 6*a* to 6*f.*

More particularly, FIGS. 6*a* to 6*f* show cross-sectional views taken in different phases of the method corresponding to a cycle of the formation of a stitch or, more exactly, of a row of stitches, of which figures:

- FIG. 6*a* is considered as the basic figure and corresponds to the phase of picking or taking up the yarn produced. In this case the sinker 9 is at its top dead centre and picks up the wavy yarn 100 which results from the accumulation of the individual fibres looped during the preceding cycle. This yarn 100 is automatically positioned in the detent 90 of the sinker 9, since it is maintained under tension by the action of the teeth 300 of the various continuously rotating looping discs 3.
- FIG. 6*b* corresponds to the phase of preparation for the transfer of the yarn. In this case, the sinker 9 experiences a downward movement to encounter the stitch-forming needle 11, for the purpose of transferring the wavy yarn 100 onto the latter. It can be seen that the stitch-forming needle 21 is present with the eye 210 open (the latch 23 in the open position).
- FIG. 6*c* corresponds to the actual phase of the transfer of the yarn. At this precise moment, the picking sinker 9 deposits the wavy yarn 100 in the eye 210 of the stitch-forming needle 21. The stroke of the sinker 9 is set in such a way that the yarn 100 exerts slight tension on the stitch-forming needle 21.
- FIG. 6*d* corresponds to the phase of the start of stitch formation; In this case, transfer has taken place and the movement of the stitch-forming needle 21 must accelerate so as to release the yarn 100 quickly from the detent 90 of the sinker 9, in order to prevent the latter from raising part of the said yarn 100 along with it. Likewise, the latch 23 of the needle 21 is pushed by the preceding stitch and pivots so as to close the eye 210 of the stitch-forming needle 21.
- FIG. 6*e* corresponds to the phase of forming the stitch and of casting it off. In this case, the latch 23 of the stitch-forming needle 21 is closed, thus allowing the wavy yarn 100 to penetrate through the preceding row of stitches and allowing the formation of a new row of stitches.

Figure 6F:
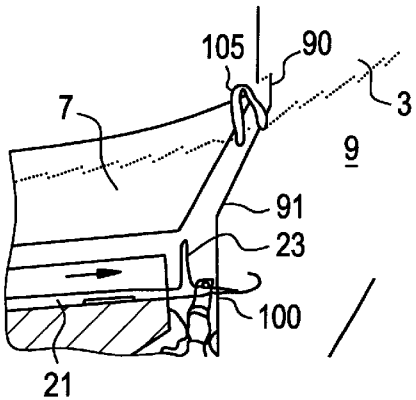

FIG. 6*f* corresponds to the phase of stripping the knit. In this case, the stitch-forming needle 21 has set off again towards its position for receiving a wavy yarn 105. The needle has encountered the nose 93 of the sinker 9, thus blocking the knitted product or knit in formation and causing the latch 23 of the needle 21 to open. During this time, the sinker 9 has risen upwards, in order to go and pick up the new wavy yarn 105 in formation.

During all the operations mentioned above, the picking sinker 9 has remained in "contact" with the end of the corresponding looping finger 7, in order to allow the formation of a new yarn 105 by accumulation of the individually looped fibres and/or filaments, the said yarn being taken up in the following cycle.

Advantageously, it can be seen that there is no sliding of the yarn in the eye 210 of the needle 21, thus making it possible to achieve a longer lifetime of the stitch-forming needles.

It was determined experimentally that strippers, as described in patent no. EP-A-0,479,880, were useful only from a stripping angle of 30°. For the prelooping heights required in knitting, this angle is reached at a disc diameter greater than 120 mm. If this condition is satisfied, strippers can be dispensed with. This makes it possible to increase the angle and depth of the teeth 300 of the disc (since any risk of jamming between the discs and the strippers is eliminated) and therefore to increase the pressure exerted by the fibres on the shank of the sinkers and relative to one another. This results in easy accumulation in the detent 90 of the sinker 9 and in a grouping of the fibres in the form of a "strand", thus accentuating the yarn appearance in the finished product.

Advantageously, as regards the production of a knitted product, the picking and transfer sinkers 9 may also serve for blocking the knitted product during the advance of the stitch-forming needle 21 and make it possible to open the eye 210 of each needle, if the latter is closed by means of a latch or blade 23.

It is also appropriate to provide a pulling device (not shown) which ensures in a conventional way that there is constant tension on the knitted product in formation.

It is appropriate to note that, since the needles operate simultaneously and the knit is by nature elastic, it is imperative that the frictional forces induced by the front of the needles 21 and the opening of the latch 23 of the needles be compensated by another "stripping system" which consists, in the present case, of the nose 93 of the sinkers 9.

When a knit is being formed on a conventional machine, the tension of the yarn is controlled by various devices, for example disc brakes. This tension is important, since it contributes to some properties of the knit (grip, elasticity) and governs the regularity of its appearance.

In the device according to the invention, it is possible to adjust the tension of the yarn by acting on the length of penetration of the needles into the sinkers.

Figure 7:
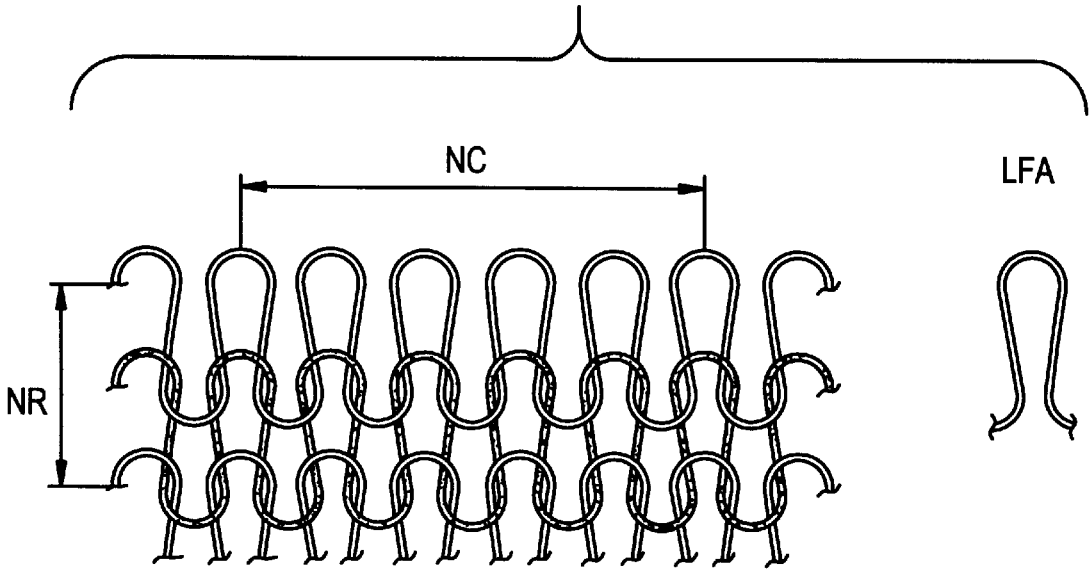
FIG. 7 shows a diagrammatic view of a jersey knitted product obtained by the method described in FIGS. 6*a* to 6*f*.

FIG. 7 illustrates a product of the jersey type obtained by means of the method described in FIGS. 6*a* to 6*f*.

Figure 8:
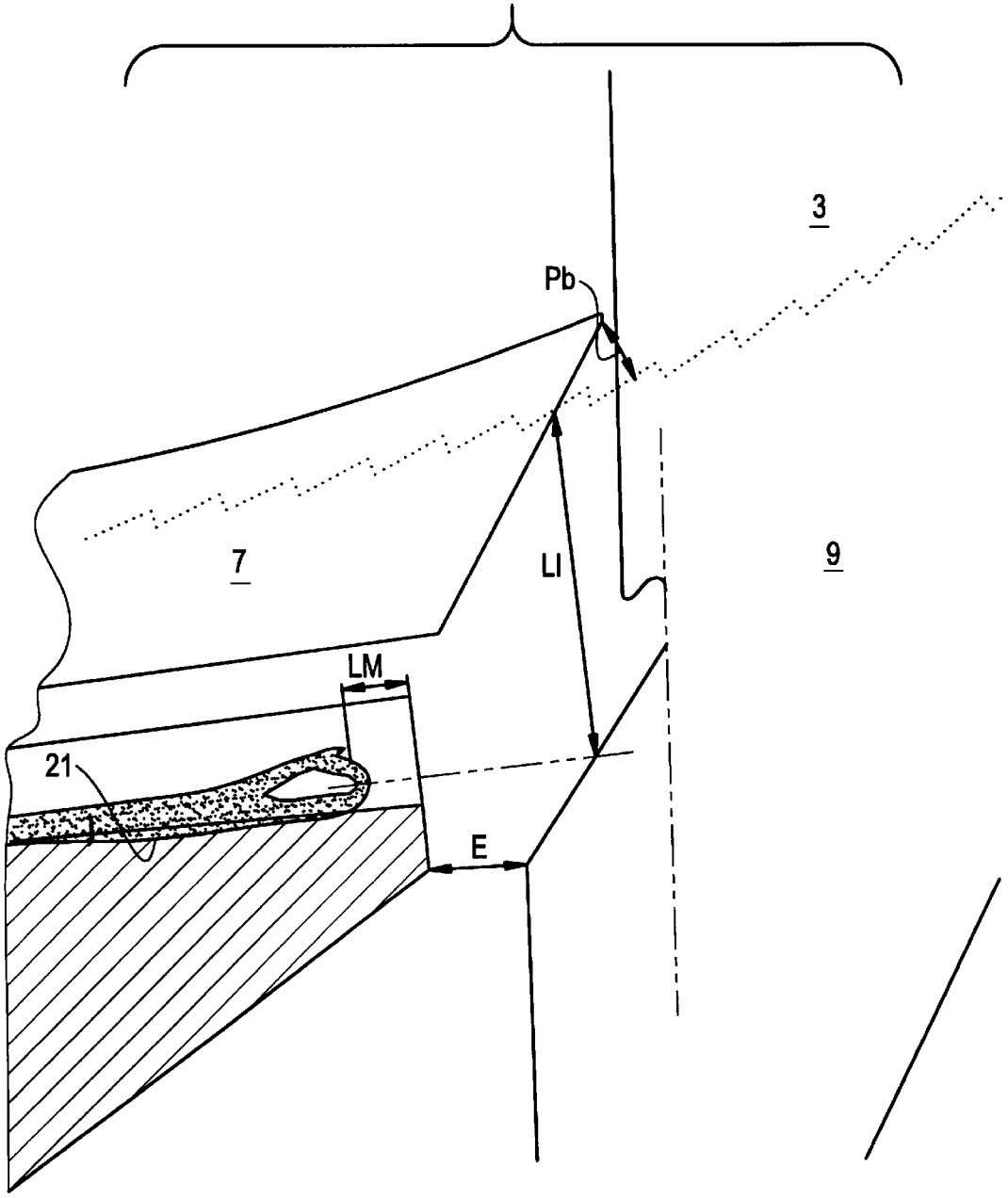
FIG. 8 shows a diagrammatic view of the various component elements of a device according to the present invention, presenting the parameters used in the production of a knitted product.

If, as shown in FIG. 8:

PB is defined as the prelooping height corresponding to the desired LFA (PB=LFA/2), and LM is defined as the length by which the needle penetrates into the sinker, in this case the tension imparted to the yarn will be a function of LM−PB. It will be found that this adjustment depends on mechanical parameters of the machine, is easy, can be reproduced perfectly on the level and in time and therefore contributes to excellent regularity of the knit produced.

In practice, the tension will not exceed a few percent so as to avoid needle fractures.

It is, of course, conceivable to use stitch-forming needles other than latch (or blade) needles described, such as compound needles (or slide needles), bearded needles, double-headed needles, etc.

Figure 11:
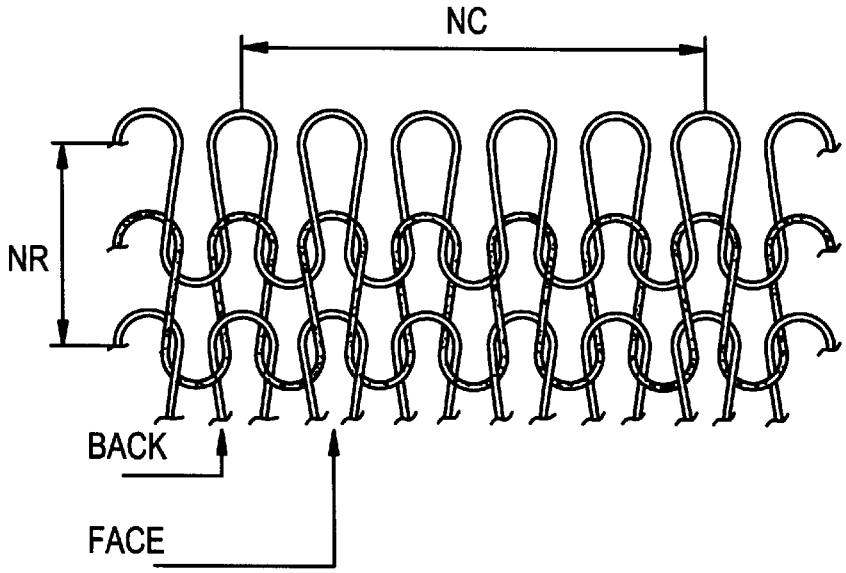
FIG. 11 shows a diagrammatic view of a knitted product in the form of ribs which is obtained by the method described in FIGS. 10*a* to 10*f*.
Figure 9:
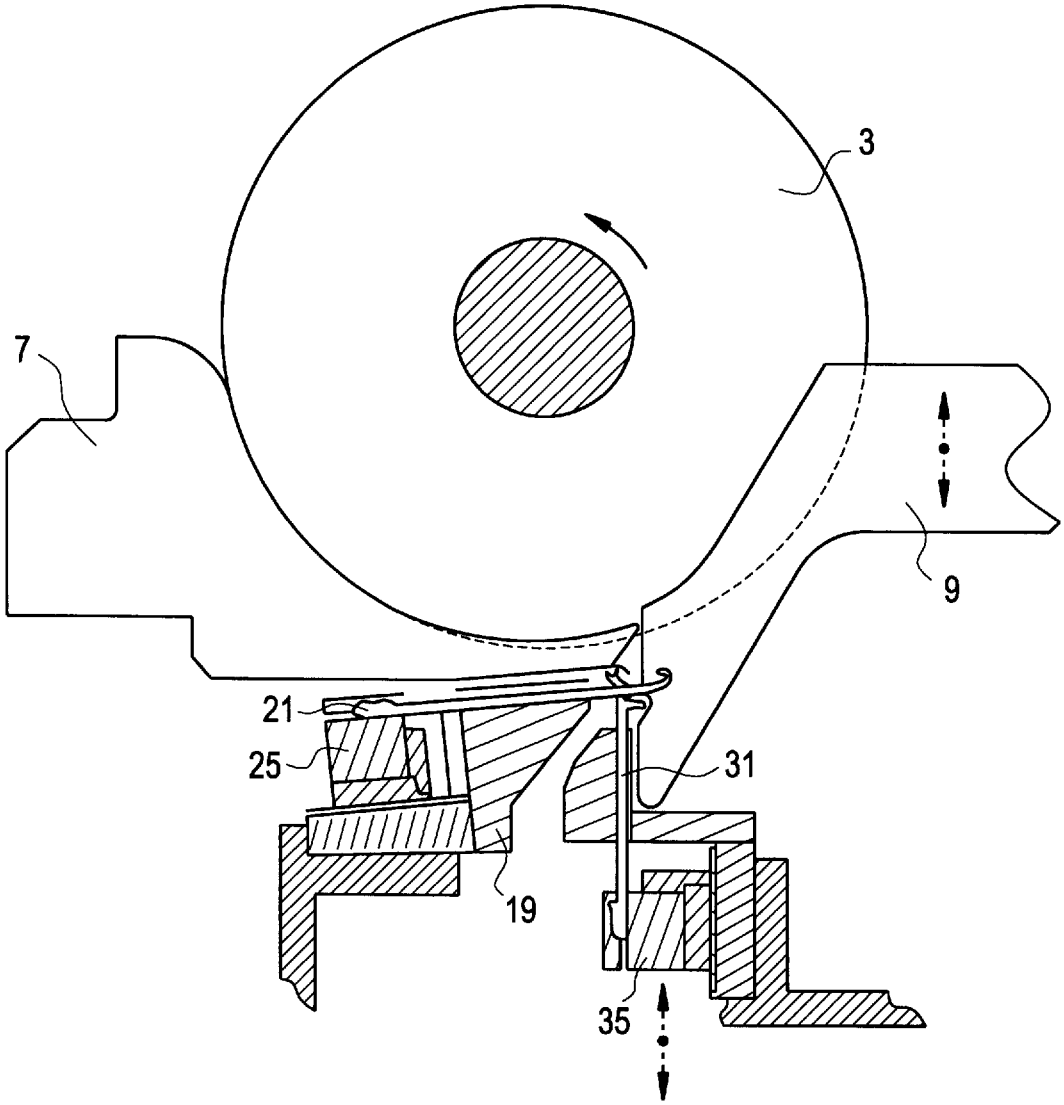
FIG. 9 shows a cross-sectional view of a device according to the present invention, intended for producing a knitted product which is in the form of ribs.

FIGS. 9, 10 and 11 describe a third embodiment of a device according to the present invention, intended for producing knitted products which take the form of ribs.

More particularly, FIG. 9 shows a cross-sectional view of a stitch-forming device, called "double-section", which makes it possible to produce rib-knitted products.

For this device, the needles are separated into two series (needle series 21 and needle series 31) which are arranged on two sections 25 and 35 forming an angle of 90° between one another. Moreover, the precise arrangement of the needles on the sections is staggered, so as to make it possible to obtain 1—1 ribs (that is to say, the production of one stitch wale on the face for one stitch wale on the back). It goes without saying that other arrangements are conceivable, such as the production of 2—2 ribs or more complex bindings.

Nevertheless, it is appropriate to note that there are twice as many needles 21 and needles 31 as looping disc elements 3, looping fingers 7 or sinkers 9. In fact, if J is the desired gauge for the knit, J/2 will be the gauge for the other elements (discs, fingers and transfer sinkers).

FIGS. 10*a* to 10*f* describe, in general terms, the various steps of the method according to the invention for the production of a rib-knitted product.

Figure 10C:
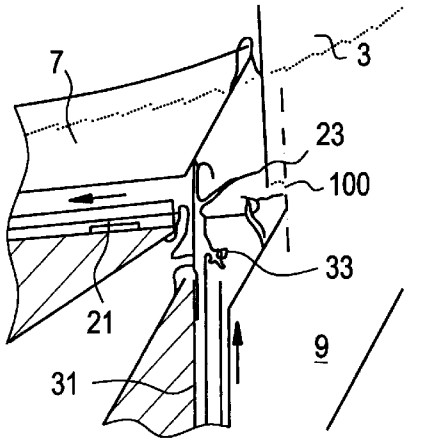
FIGS. 10*a* to 10*f* show a general view of the various steps of the method according to the invention which makes it possible to form the knitted product in the form of ribs.
Figure 10B:
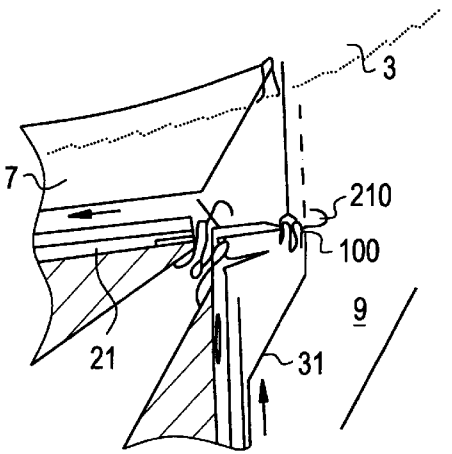
Figure 10A:
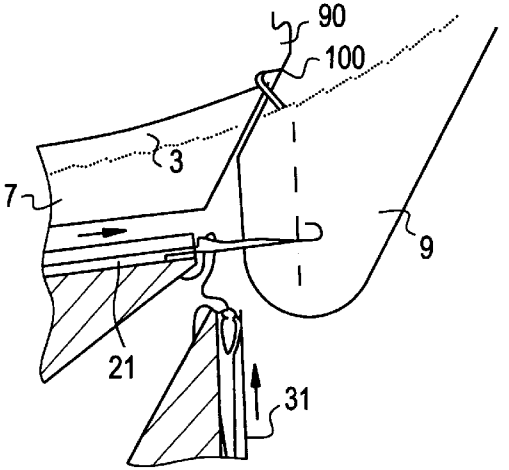

More particularly, these figures show cross-sectional views taken in different phases of the method, of which figures:

FIG. 10*a* is considered as the basic figure and shows the phase of picking or taking up the yarn. This step is wholly identical to that described for the method intended for a jersey product (see FIG. 6*a*). In this case, only the horizontal needles 11 work.

FIG. 10*b* corresponds to the phase of transferring the sinker 9 towards the first series of horizontal needles 21. Once again, this step corresponds fully to the transfer step executed in the case of the production of a jersey product (see FIG. 6*b*).

FIG. 10*c* corresponds to the phase of the start of stitch formation. In this case, the horizontal needles 21 drive the yarn 100 into the row of preceding stitches, whilst the vertical needles 31 are positioned so as to receive the yarn. Consequently, the latches 33 of the vertical needles are therefore open. In this embodiment, the stripping function is performed by the horizontal needles 21.

Figure 10F:
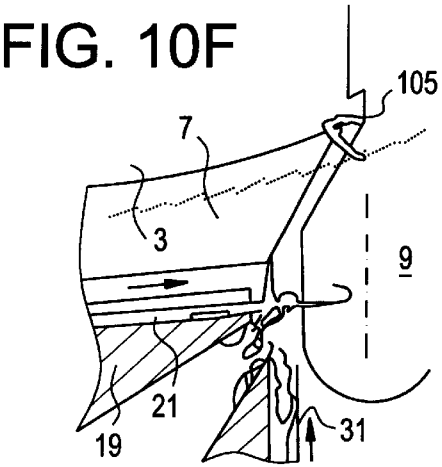
Figure 10E:
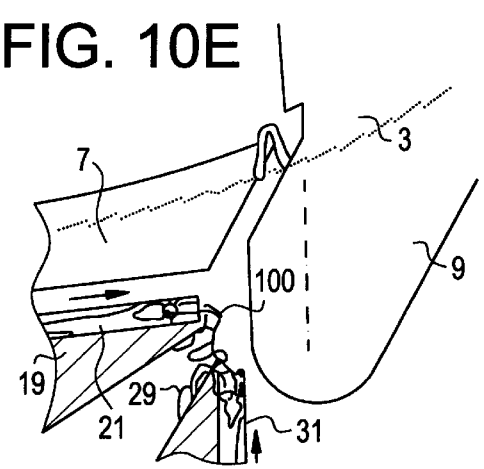
Figure 10D:
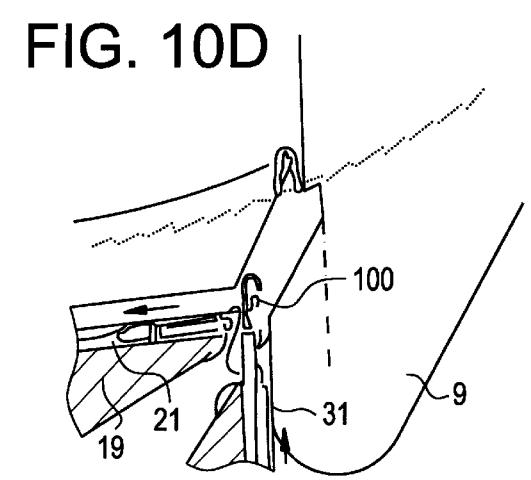

FIG. 10*d* corresponds to the phase of the second transfer of the horizontal needles 21 towards the vertical needles 31. In this case, the horizontal needles 21 are at their rear dead centre and have just terminated the formation of the corresponding stitches. The penetration distance into the casting-off sinker 19 in the case of the horizontal needles 21 corresponds approximately to the prelooping height. The yarn 100 is then tensioned on the horizontal needles 21.

FIG. 10*e* corresponds to the phase of the end of stitch formation. In this case, the horizontal needles 21 have advanced in order to allow the vertical needles 31, in turn, to form the stitches. The movements of the sections 25 and 35 make it possible for the yarn to remain tensioned during this operation. At this moment, the penetration distances of the needles into their respective casting-off sinkers are identical and correspond to the LFA of the knit.

FIG. 10*f* corresponds to the phase of stripping of the knit. In this case, the horizontal needles 21 advance and stripping is carried out as a result of the retention of the knit by the vertical needles 31 and, if appropriate, by means of the nose 93 of the sinker 9. At this moment, the latch 23 of the horizontal needles 21 can open and receive the new yarn 105 intended for producing the following stitch.

FIG. 11 illustrates a product in the form of ribs, which is obtained by the method described in FIGS. 10*a* to 10*f*.

Figure 12:
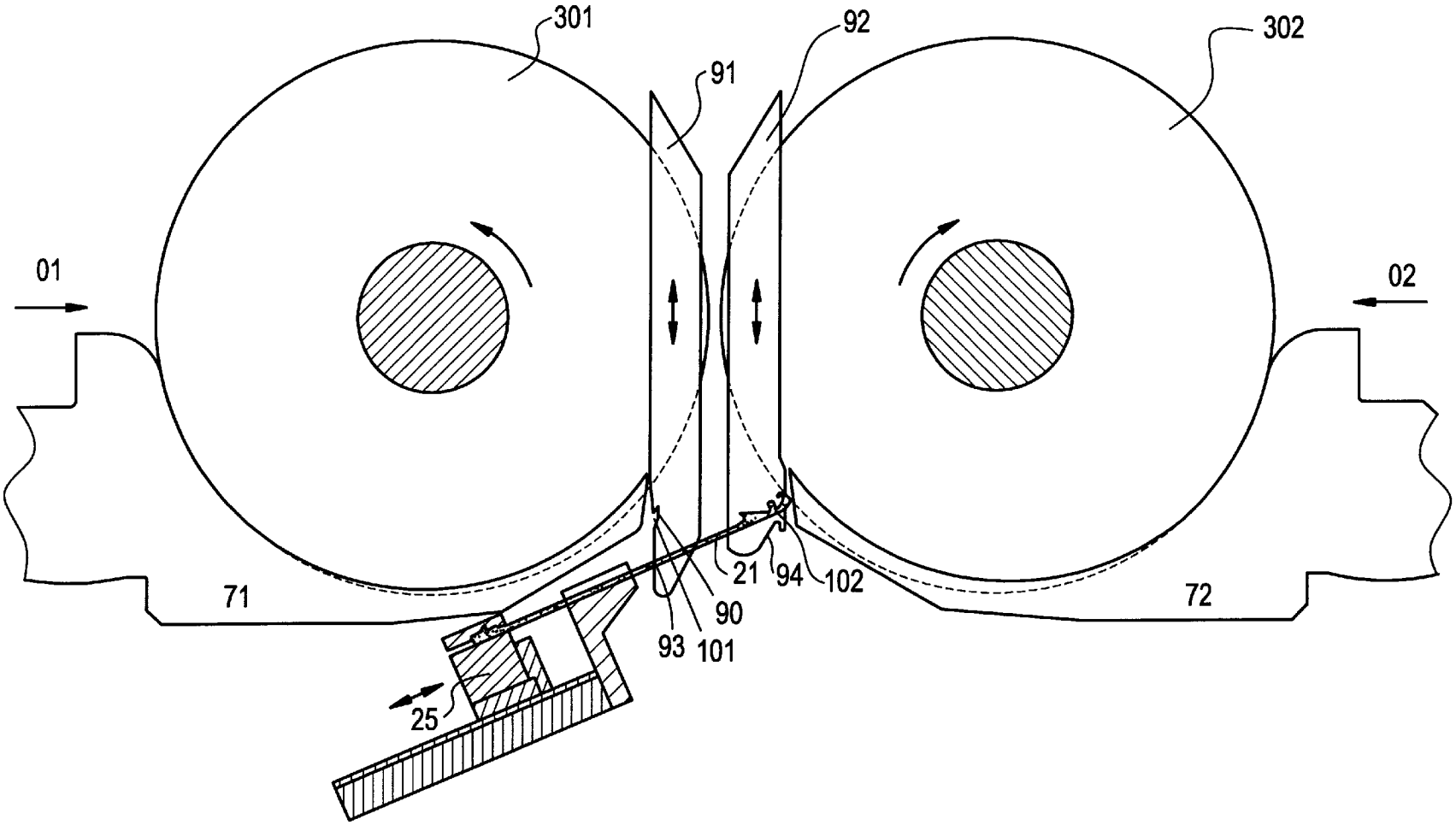
FIG. 12 shows a cross-sectional view of a device according to the present invention, intended for producing a raised-nap or plaited knitted product.

FIG. 12 shows a cross-sectional view of a device according to the present invention, making it possible to produce a knitted product which is jersey-based, but which has pile loops on the back.

In FIG. 12, the device according to the present invention is supplied with two webs 01 and 02 which either come from two different cards or have been pre-stored separately or come from two combers of the same card. These two webs are processed through two separate assemblies of looping discs 301 and 302 and of looping fingers 71 and 72 for the purpose of forming two completely independent yarns 101 and 102. Preferably, there is provision for the two yarns 101 and 102 to have been looped at different heights, the yarn 101 having been looped at a height lower than the looping height of the yarn 102. These yarns are subsequently dispensed in turn during the same cycle towards a single series of stitch-forming needles 21 by two sinkers 91 and 92 and are knitted according to the jersey logic previously described in FIGS. 3 to 6. The second sinker 92 preferably has a truncated shape (absence of a nose 93) to allow the passage of the yarn which it deposits, the sinker 91 alone performing the stripping function (presence of a nose 93).

According to a preferred embodiment, it is conceivable to shear the looped product on the back for the purpose of obtaining a pile after shearing. In this case, the so-called short stitches produced by the yarn 101 form the actual knit and the long stitches, formed by the yarn 102 and partly retained by the knit, provide the pile.

According to another embodiment, it is conceivable that the prelooping heights are identical for the two yarns, but two yarns are produced from fibres of differing nature, linear density or colour, for the purpose of obtaining a plaited product.

Figure 13:
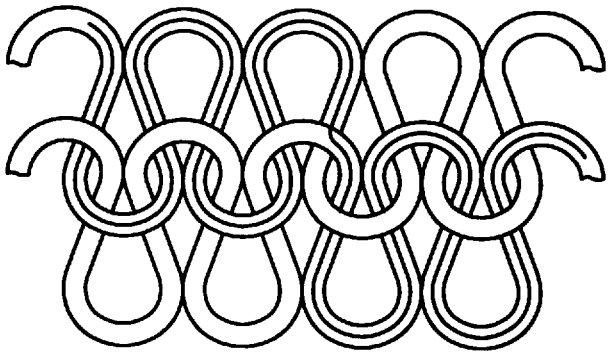
FIG. 13 shows a diagrammatic view of a knitted product in which an interfering fibre appears.
Figure 14:
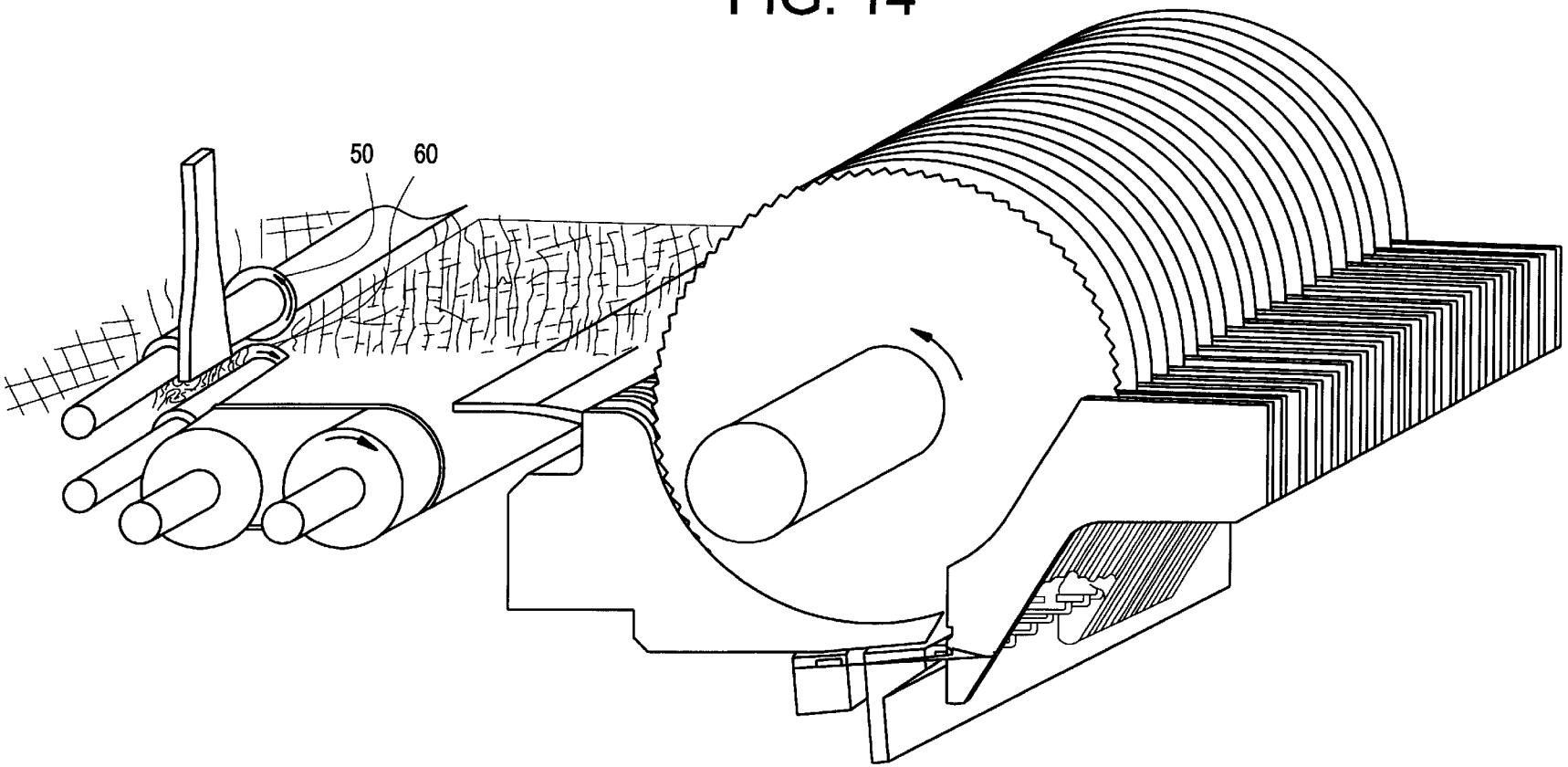
FIG. 14 shows a perspective view of a device according to the present invention, intended for producing a fully-fashioned knitted product.

The products obtained by the methods and devices described in FIGS. 3 to 12 all have the essential characteristic of unravellability (or the fact that a product is difficult to unravel), which is attributable to the presence of a network of interfering fibres. In fact, at the end of the formation of a yarn, some fibres may, on the one hand, have one end which participates in producing a first yarn, whilst the other end is still present in the looping system and therefore participates in the production of the following yarn. Consequently, as shown in FIG. 13, the same fibre may participate in the formation of two consecutive rows of stitches. Such fibres are called interfering fibres.

Returning to the definitions and parameters given in FIG. 6, we have:

LI which is the distance between the axis of formation of the stitches and which governs the average length of the interfering fibres.

If LI is close to PB (that is to say, if LI<3PB), the interfering fibres will be tensioned between two consecutive rows and will not appear visually on the back of the product. In this case, the fibres will increase the cohesion of the product by making it very difficult to unravel, whatever the binding (jersey-type or rib-type product).

If LI is much greater than PB (with the condition LI>3PB), the interfering fibres will appear on the back of the knitted product in the form of loops. In this case, the product is likewise unravellable.

The percentage of interfering fibres is a function of the length of the fibres and of the condensed length of the web, that is to say the web length necessary for producing a yarn. This ratio of interfering fibres is preferably varied between 2 and 25%. In some cases, the interfering fibres may even interfere on three rows 6*f* stitches or even more. This idea of interfering fibres makes it possible to influence other characteristics of the knit, such as elasticity, resistance to pilling, washing behaviour, dimensional stability, etc.

Another important characteristic of the products obtained is that stitch formation is perfectly balanced and that the knit has no tendency to curl, even when a product in jersey form is produced.

Other improvements and products may, of course, be considered, such as the production of pseudo-jacquard by direct relation to the web before it enters the machine or by the composite nature of the knit attributable to the superposition of a plurality of webs.

Another example of the use of the present invention is the production of products, called fully-fashioned products, which, by means of sequential knitting, make it possible to produce "shaped" products directly. According to this aspect, the entry web is cut in width to the desired shape and, consequently, a knitted product of non-constant width (increasing or decreasing) is produced.

The main problem in producing such products is the formation of the selvedges. According to the present invention, this problem is easily solved due to the fact that the selvedge will be correctly formed, even if the width of the web supplied is smaller than the working width of the elements. In fact, if the selvedge stitching is poorly formed, the material will nevertheless be extracted from the needle by the adjacent stitches in the course of the cycle, thereby ruling out any stuffing phenomenon. Furthermore, the network of interfering fibres will ensure the blocking of the selvedge stitches. Nevertheless, it can be seen that, in practice, it is appropriate if the "increases" or "decreases" do not exceed 2×2.5/J, that is to say do not affect more than two needles per row. In fact, in this case, the general drawing of the knit will suffice for the proper formation of the selvedge stitches.

One improvement involves using compound needles instead of traditional needles, in order to ensure that the eye opens during the "increases" (in fact, in the absence of material, the latches of traditional needles exhibit completely uncontrolled behaviour).

The width of the web can be varied by various techniques, such as suction or the mechanical or thermal cutting of the web.

FIG. 12 illustrates a particular embodiment of a device intended for producing such a fully fashioned knitted product. In this case, a device having rotary knives (50 and 60) is used in order to increase the cutting efficiency. If appropriate, the arrangement of a plurality of sets of rotary knives may be considered, in order to increase the degree of fashioning and, in particular, where the production of a pullover is concerned, one set makes it possible to separate the sleeves from the body and another set of knives makes it possible to produce the neck opening. The cut material not used by the machine can be recycled directly, for example pneumatically upstream of the line.

An important purpose of the method is to increase productivity. In fact, several aspects contribute to increasing this productivity. Mention may be made of the various factors playing an important part in the increase of this productivity: the elimination of the spinning step, the increase in the work rates by the execution of low-amplitude movements, the simultaneous working of all the needles, etc.

In economic terms, the use of a method according to the present invention makes it possible to achieve savings which may reach a factor of 100 in favour of the methods according to the invention, as compared with the methods employing techniques which involve separate spinning.

Moreover, the fact that there is no need to execute an intermediate step of independent spinning in order to produce a yarn allows many advantages.

In particular, mention may be made, as an example, of the fact that the raw material can be stored directly in the form of fibres, without the need to provide intermediate stocks of yarns. This means, inter alia, a low generated stock value.

Another advantage is immediate adaptation on request, without the need to wait until a yarn is produced. It is also possible to consider an instantaneous or virtually instantaneous choice of the linear density of the yarn, once again without the need to go through a spinning step. It is also possible to consider varying the linear density directly on the machine, for example by varying the looping height.

By virtue of the method of the present invention, it may also be considered that small series can easily be generated, for example by introducing a desired quantity of fibres into the line.

From an aesthetic point of view, the production of an entire series of fancy yarns (the addition of shading, mixture of fibres, etc.).

Moreover, there will be maximum saving in the case of sophisticated yarns (fancy or composite yarns) and fine yarns (the method according to the invention would make it possible to obtain linear densities even finer than those obtained by conventional spinning techniques) and in the case of the use of fibres which are difficult to spin, such as regenerated fibres, ultrafine fibres or even industrial fibres.

In conclusion, the various embodiments of the methods and devices described above all make it possible to separate the step of forming a pseudo-yarn from the step of producing the actual product which may be either a floor covering product or a knitted product. This affords the advantageous possibility of using the conventional members of tufting or stitch-forming machines by producing the relevant products directly from fibres and/or filaments.

We claim:

1. A method for producing textile products from a web of fibers comprising the steps of a) conveying the web along a feed path toward a loop forming and drawing station, b) subjecting the fibers in the web to transverse looping accompanied by drawing, c) accumulating the looped and drawn fibers into a yarn-like strand with the fibers in substantial parallelism, d) isolating the entire length of the strand as a separate unit, e) conveying the isolated strand toward textile-forming needles, and f) capturing the conveyed strand within the textile-forming needles for subsequently forming the textile products.

2. The method of claim 1 wherein the isolating and conveying steps are performed at substantially the same time.

3. The method of claim 1 wherein the needles that capture the strands are tufting needles.

4. The method of claim 1 wherein the needles that capture the strands are stitch-forming needles.

5. The method of claim 1 including the step of moving the needles toward and away from a strand-capturing station for capturing sequentially conveyed isolated strands.

6. The method of claim 5 wherein the movement of the needles is at a first amplitude and the step of conveying the strand toward the needles is at an amplitude different from the first amplitude.

7. The method of claim 5 wherein movement of the textile product is blocked during at least a portion of the needle moving step.

8. The method of claim 5 wherein the step of moving the needles includes the steps of producing a row of stitches and subsequently transferring said row of stitches for forming the textile products.

9. The method of claim 8 wherein two series of needles are provided and the subsequent transfer of said row of stitches is toward the second series of needles.

10. The method of claim 9 wherein the second series of needles moves in a direction perpendicular to the movement of the needles toward and away from the strand-capturing station, the two series of needles being arranged in a staggered manner.

11. The method of claim 9 wherein a plurality of yarn-like strands are accumulated and isolated simultaneously and conveyed toward textile-forming needles for successive capture and successive production of a plurality of rows of stitches.

12. The method of claim 1 wherein the length of the yarn-like strand is changed to provide a variation in the width of the textile product.

13. An apparatus for producing textile products from a moving web of fibers comprising a plurality of rotary looping elements spaced from one another transverse to the movement of the web, looping fingers positioned intermediate the looping elements and cooperating therewith to draw the fibers and impart a wavy configuration to the fibers within the web, a picking and transfer sinker in alignment with each looping finger for accumulating the fibers into a yarn-like strand with the fibers in substantial parallelism and isolatively transferring the accumulated strand from the web and textile forming needles spaced from the strand accumulating web for receiving the transferred strand from the sinker for producing the textile products.

14. The apparatus of claim 13 characterized in that the needles are tufting needles (11) intended for producing floor and wall covering.

15. The apparatus of claim 13 characterized in that the needles are stitch-forming needles (21) intended for producing a knitted product.

16. The apparatus of claim 13, characterized in that the picking and transfer sinkers (9) have a recess (90) intended for accumulating the fibers for the purpose of producing the wavy strand.

17. The apparatus of claim 15, characterized in that the picking and transfer sinkers (9) have a projection (93) for blocking the knitted product during the advance of the stitch-forming needles (21).

18. The apparatus of claim 15 characterized in that the stitch-forming needles are separated into two series (21 and 31) which successively process the wavy strand.

19. The apparatus of claim 13, characterized in that there are twice as many needles (21 and 31) as looping elements (3), looping fingers (7) or picking and transfer sinkers (9).

20. The apparatus of claim 18, characterized in that the two series of needles (21 and 31) are arranged on two movable sections (25 and 35) arranged at 90 degrees.

21. The apparatus of claim 18 characterized in that the needles of the two series of stitch-forming needles (21 and 31) are arranged in a staggered manner.

22. The apparatus of claim 15, characterized in that two separate assemblies of looping discs (301 and 302) and of looping fingers (71 and 72) are provided for the purpose of forming two completely independent strands (101) and (102) which are successively transferred toward a single series of stitch-forming needles (21) by means of two series of sinkers (91 and 92).

* * * * *

UNITED STATES PATENT AND TRADEMARK OFFICE

CERTIFICATE OF CORRECTION

PATENT NO. : 5,867,880

DATED : Feb. 9, 1999

INVENTOR(S) : Bathelier, et al.

It is certified that error appears in the above-identified patent and that said Letters Patent is hereby corrected as shown below:

Claim 11, column 14, line 33, delete "9" and insert --1--.

Signed and Sealed this

Twenty-first Day of December, 1999

*Attest:*

Q. TODD DICKINSON

*Attesting Officer*

*Acting Commissioner of Patents and Trademarks*